US011747073B2

(12) United States Patent
Yu et al.

(10) Patent No.: US 11,747,073 B2
(45) Date of Patent: Sep. 5, 2023

(54) REFRIGERATOR

(71) Applicant: LG ELECTRONICS INC., Seoul (KR)

(72) Inventors: Seonil Yu, Seoul (KR); Daesung Lee, Seoul (KR); Kyutae Park, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 17/414,101

(22) PCT Filed: Dec. 9, 2019

(86) PCT No.: PCT/KR2019/017287

§ 371 (c)(1),
(2) Date: Jun. 15, 2021

(87) PCT Pub. No.: WO2020/145520

PCT Pub. Date: Jul. 16, 2020

(65) Prior Publication Data

US 2022/0065518 A1 Mar. 3, 2022

(30) Foreign Application Priority Data

Jan. 10, 2019 (KR) ..... 10-2019-0003204

(51) Int. Cl.
*F25D 17/04* (2006.01)
*F25D 23/08* (2006.01)
(Continued)

(52) U.S. Cl.
CPC ..... *F25D 17/045* (2013.01); *F25D 23/087* (2013.01); *F25D 25/02* (2013.01); *F25D 29/005* (2013.01); *F25D 2400/36* (2013.01)

(58) Field of Classification Search
CPC ..... F25D 23/087; F25D 17/045; F25D 25/02; F25D 2317/062; F25D 2325/023;
(Continued)

(56) References Cited

U.S. PATENT DOCUMENTS 2,363,530 A 11/1944 Iwashita
2,412,904 A 12/1946 Money et al.
(Continued)

FOREIGN PATENT DOCUMENTS

CN 102042740 A 5/2011
KR 1020090075074 A 7/2009
(Continued)

*Primary Examiner* — Hiwot E Tefera
(74) *Attorney, Agent, or Firm* — DENTONS US LLP

(57) ABSTRACT

The present disclosure relates to a refrigerator. The refrigerator includes first storage for defining a first storage space therein, a door for opening and closing the first storage space, and a plurality of shelves installed in the first storage space for placing food thereon. The door includes a door frame having an opening defined therein, and mounted pivotable to the first storage, a panel assembly inserted into the opening, and disposed to allow the first storage space to be seen through, and a flow path blocking portion mounted on the door frame, wherein the flow path blocking portion shields a gap defined between the panel assembly and the shelf as the door closes the first storage space.

15 Claims, 8 Drawing Sheets

(51) Int. Cl.
*F25D 25/02* (2006.01)
*F25D 29/00* (2006.01)

(58) Field of Classification Search
CPC ..... F25D 23/02; F25D 11/02; F25D 29/005; F25D 2400/36; F25D 23/069; F25D 2325/022; F25D 23/028; F25D 2400/04
See application file for complete search history.

(56) References Cited

U.S. PATENT DOCUMENTS 2,509,610 A * 5/1950 Philipp ..... F25D 21/14 62/DIG. 13
2,584,089 A * 1/1952 Hillenbrand ..... A47B 79/00 312/228
5,306,082 A 4/1994 Karlin et al.
5,577,822 A 11/1996 Seon
6,290,314 B1 * 9/2001 Kim ..... F25D 23/069 312/401
7,337,628 B2 3/2008 Okuda et al.
9,823,013 B1 * 11/2017 Caglin ..... F25D 23/087
10,132,557 B2 * 11/2018 Caglin ..... F25D 23/087
11,454,441 B2 * 9/2022 Staud ..... F25D 25/025
2005/0138955 A1 * 6/2005 Okuda ..... F25D 25/02 312/401
2007/0062226 A1 * 3/2007 Gomoll ..... A47F 3/0434 68/34
2010/0307065 A1 * 12/2010 Eckartsberg ..... F25D 23/087 49/475.1
2018/0112906 A1 * 4/2018 Yi ..... F25D 21/04
2018/0180349 A1 * 6/2018 Han ..... F25D 23/04
2018/0274852 A1 * 9/2018 Kang ..... F25D 23/025
2018/0363974 A1 * 12/2018 Costa ..... F25D 23/069

FOREIGN PATENT DOCUMENTS

KR 10-2016-0148225 A 12/2016
KR 10-2018-0078334 A 7/2018

* cited by examiner

REFRIGERATOR

This application is a national phase of International PCT/KR2019/017287, filed Dec. 9, 2019, which claims the benefit of Korean Patent Application No. 10-2019-0003204, filed Jan. 10, 2019, the contents of which are all hereby incorporated by reference herein in their entirety.

TECHNICAL FIELD

The present disclosure relates to a refrigerator, and more particularly, to a refrigerator having a plurality of storage spaces defined therein.

BACKGROUND ART

In general, a refrigerator is an apparatus that uses a refrigeration cycle composed of a compressor, a condenser, an expansion valve, and an evaporator to maintain a temperature of a storage compartment disposed in the refrigerator at a predetermined temperature, thereby freezing or refrigerating and storing food or the like. The refrigerator generally includes a freezing compartment for freezing and storing the food or drink and a refrigerating compartment for storing the food or the drink at a low temperature.

The refrigerator may be distinguished by positions of the freezing compartment and the refrigerating compartment. For example, the refrigerator may be divided into a top mount type in which the freezing compartment is located above the refrigerating compartment, a bottom freezer type in which the freezing compartment is located below the refrigerating compartment, and a side by side type in which the freezing compartment and the refrigerating compartment are divided into left and right sides by a partition.

Recently, a refrigerator, which, in order to meet various needs of consumers, may freely adjust temperatures of the refrigerating compartment and the freezing compartment depending on food stored in the refrigerator, and may allow the freezing compartment to have the same temperature as the refrigerating compartment, so that the refrigerating compartment of a larger space may be used, has been proposed and used.

Storage days of the food varies depending on a type and processing and packaging conditions, and recently, a refrigerator has been used to properly store items such as cosmetics, wine, or the like.

It is known that the wine is in a state of ripening in a bottle, so that special care and effort should be paid to handling and storage of the wine. When handling and storing the wine, attention should be paid to temperature, sunlight, humidity, vibration, levelness, and the like. The sunlight, humidity, and levelness may be solved relatively simply, but much research and effort have been made to maintain proper temperature and to block vibration.

An environment in which the wine is stored is preferably a place where ventilation is good, a change in the temperature/humidity is small, and there is no vibration. As such an environment, there have been a underground warehouse, a cave, a basement floor, and the like. However, such a natural environment is very difficult to find, so that the refrigerator has been used to artificially create such an environment.

Further, in order to obtain optimum flavor by the refrigerator, it is important to implement a particularly suitable temperature environment, among the above-mentioned various conditions such as the temperature, humidity, ventilation, and the like. A suitable temperature for storing the wine is known to be about 12 to 18° C. for red wine and about 6 to 11° C. for white wine.

Therefore, in order to store the wine bottles requiring such various temperature conditions in one storage space, the refrigerator is configured such that an internal space thereof may be divided into a plurality of spaces, and the divided plurality of spaces may individually control the temperature.

In addition, a conventional refrigerator has a plurality of shelves for storing a plurality of wine bottles, and the plurality of shelves are spaced apart from each other by a predetermined spacing such that the wine may be stored.

Further, the conventional refrigerator generally stores the wine by specifying the storage space thereof depending on the type of the wine based on a temperature distribution, which is naturally formed based on flow of cold air in the storage space where the wine is stored.

That is, the storage space of the wine is specified using a phenomenon in which an upper portion of the storage space has a relatively high storage temperature and a lower portion of the storage space has a relatively low storage temperature based on the temperature distribution formed by the flow of the cold air of the storage space where the wine is stored.

DISCLOSURE

Technical Problem

The present disclosure is devised to solve the above problems, and one purpose of the present disclosure is to provide a refrigerator that allows air flow in a storage space where food is stored to be controlled, so that temperatures in regions of the storage space may be different.

Further, the present disclosure is devised to solve the above problems, and another purpose of the present disclosure is to provide a refrigerator that includes a blocking plate, which may selectively control flow of air in a storage space, on a door for opening and closing the storage space in which food is stored, so that temperatures in regions of the storage space may be different.

Technical Solution

A refrigerator according to an embodiment of the present disclosure for achieving the above-mentioned purposes preferably includes first storage for defining a first storage space therein, a door for opening and closing the first storage space, and a plurality of shelves installed in the first storage space for placing food thereon, wherein the door includes a flow path blocking portion mounted on the door, wherein the flow path blocking portion shields a gap defined between the door and the shelf as the door closes the first storage space.

Further, it is preferable that the flow path blocking portion is fixed on the door in a selectively detachable manner to correspond to positions of the plurality of shelves.

Further, it is preferable that the flow path blocking portion has a gasket at a longitudinal end thereof to be in close contact with the shelf.

Further, it is preferable that the door includes a door frame having an opening defined therein, and mounted pivotable to the first storage, and a panel assembly inserted into the opening, and disposed to allow the first storage space to be seen through.

Further, it is preferable that the flow path blocking portion is mounted on the door frame, and shields a gap defined between the panel assembly and the shelf as the door closes the first storage space.

Further, it is preferable that the door frame includes an outer plate forming a front face of the door, and a door liner disposed rearward of the outer plate to form a rear face of the door.

Further, it is preferable that the flow path blocking portion is mounted on the door liner to shield a gap defined between the panel assembly and the shelf.

Further, it is preferable that each of both opposing inner side faces of the door defining the opening is inclined inwardly of the door such that the panel assembly is inserted and installed into the door frame, and wherein the flow path blocking portion is mounted between the inner side faces.

Further, it is preferable that a plurality of pairs of grooves are respectively defined in the inner side faces at positions corresponding to the plurality of shelves, wherein both ends of each flow path blocking portion are inserted and fixed in a single pair of grooves, respectively.

Further, it is preferable that the flow path blocking portion includes a blocking plate formed in a plate shape of a transparent material.

Further, it is preferable that a gasket in contact with a front end of the shelf is further formed at an end of the blocking plate.

Further, it is preferable that the gasket includes a buffer having a hollow defined therein to be in contact with the shelf with a predetermined elastic force.

Further, it is preferable that the panel assembly includes a front panel for shielding the opening and forming a front face of the panel assembly, a heat insulating panel formed to be spaced apart from the front panel by a predetermined distance and forming a rear face of the panel assembly, and a spacer bar disposed between the front panel and the heat insulating panel to define a heat insulation space together with the front panel and the heat insulating panel.

Further, it is preferable that the flow path blocking portion blocks a flow path between an inner face of the heat insulating panel and a front end of the shelf.

Further, it is preferable that second storage having a second storage space defined therein is disposed below the first storage, wherein the second storage space is operated independently of the first storage.

Further, it is preferable that the second storage includes at least one drawer extended from the second storage space to open the second storage space.

Further, it is preferable that the door further includes a manipulator for controlling the first storage and the second storage, and a display for displaying operating states of the first storage and the second storage.

Alternatively, a refrigerator according to an embodiment of the present disclosure for achieving the above-mentioned purposes preferably includes first storage for defining a first storage space therein, a door for opening and closing the first storage space, and a plurality of shelves installed in the first storage space for placing food thereon. The door includes a door frame having an opening defined therein, and mounted pivotable to the first storage, a panel assembly inserted into the opening, and disposed to allow the first storage space to be seen through, and a flow path blocking portion mounted on the door frame, wherein the flow path blocking portion shields a gap defined between the panel assembly and the shelf as the door closes the first storage space.

Advantageous Effects

According to the present disclosure, the refrigerator may allow the air flow in the storage space in which the wine is stored to be controlled, so that the temperatures in the regions of the storage space may be different.

Further, according to the present disclosure, the refrigerator may include the blocking plate, which may selectively control the flow of air in the storage space, on the door for opening and closing the storage space in which the wine is stored, so that the temperatures in the regions of the storage space may be different.

BEST MODE

Hereinafter, a refrigerator according to an embodiment of the present disclosure will be described in detail. In describing the present disclosure, the names of the components to be defined are defined in consideration of their functions in the present disclosure. Therefore, it should not be understood to limit the technical components of the present disclosure. In addition, each name defined to each component may be referred to as another name in the art.

First, a refrigerator according to an embodiment of the present disclosure will be described in detail with reference to the accompanying drawings.

Figure 1:
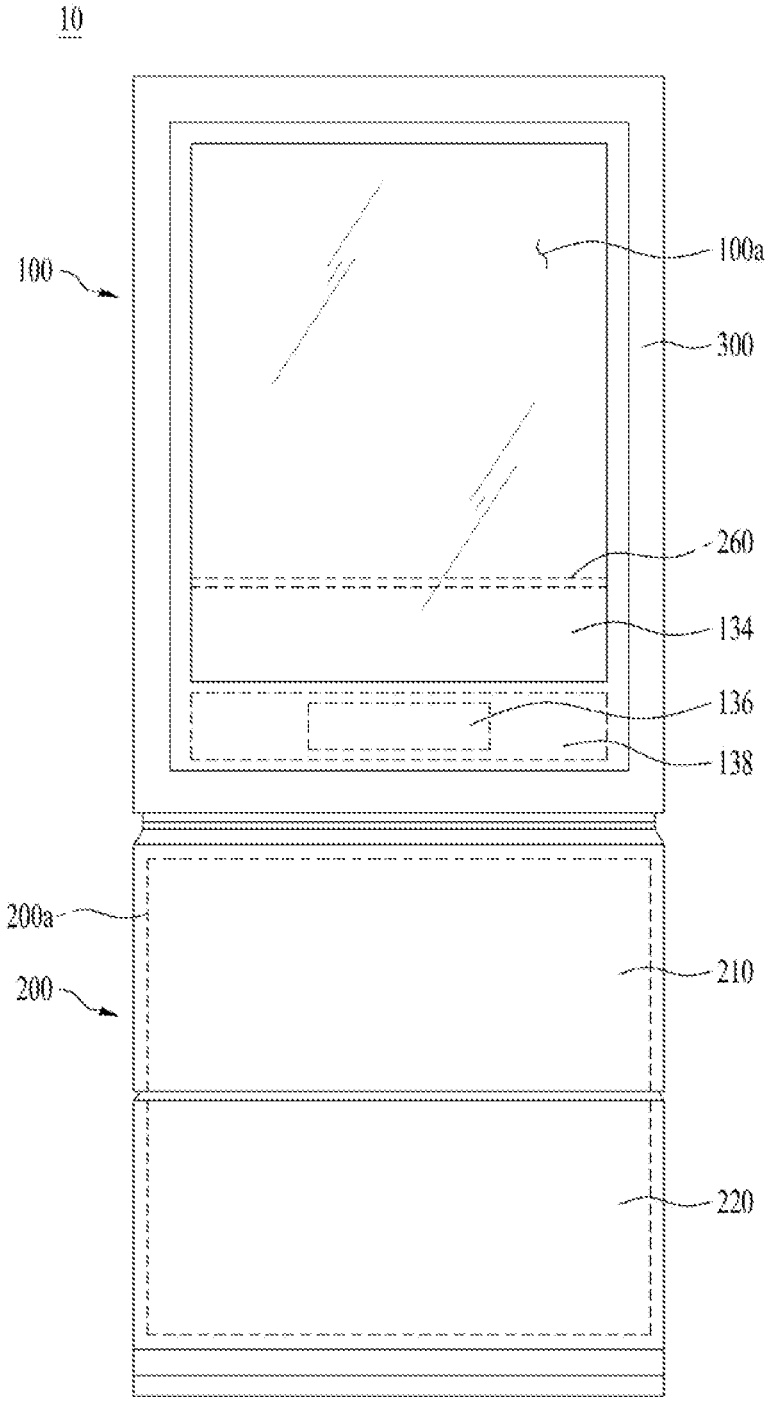
FIG. 1 is a front view illustrating a refrigerator according to the present disclosure.
Figure 2:
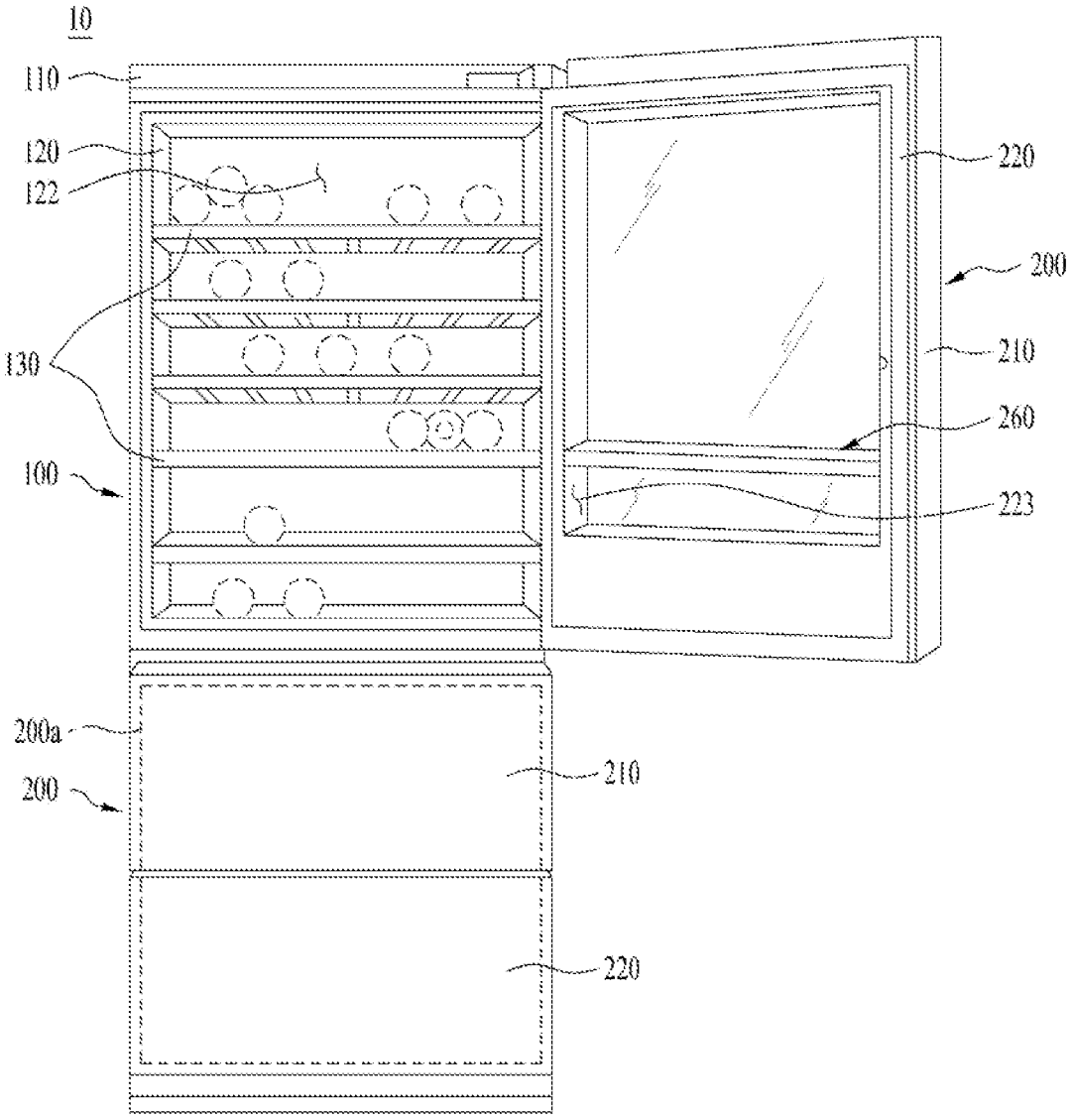
FIG. 2 is a front view illustrating a state in which a door of a refrigerator according to the present disclosure is open.

FIG. 1 is a front view illustrating a refrigerator according to the present disclosure, and FIG. 2 is a front view illustrating a state in which a door of a refrigerator according to the present disclosure is open.

As shown in FIGS. 1 to 2, a refrigerator 10 according to the present disclosure is formed in a substantially rectangular parallelepiped shape with an open front face. The refrigerator 10 includes first storage 100 positioned at an upper portion of the refrigerator 10 and having a first storage space 100*a* defined therein, and second storage 200 positioned below the first storage 100 and having a second storage space 200*a* defined therein, which is extended and retracted in a drawer form.

In this connection, the first storage space 100*a* or the second storage space 200*a*, which is a storage space for storing food, may be selectively provided as a refrigerating compartment or a freezing compartment. In the present embodiment, for convenience of description, the first storage space 100*a* and the second storage space 200*a* will be described as being used as the refrigerating compartment as an example, but the present disclosure is not limited thereto.

That is, depending on a type or a temperature of the food stored in the first storage space 100*a* or the second storage space 200*a*, the first storage space 100*a* and the second storage space 200*a* may be selectively used as the refrigerating compartment/freezing compartment or the freezing compartment/refrigerating compartment, respectively. Alternatively, both the first storage space 100*a* and the second storage space 200*a* may be used as the refrigerating compartments or the freezing compartments.

Further, the first storage space 100*a* has a front opening, and a door 300 for opening and closing the first storage space 100*a* is pivotably disposed at one side of the opening.

In addition, the first storage space 100*a* may have a plurality of shelves for loading the food to be stored in the first storage space 100*a*. In the embodiment of the present disclosure, the present disclosure may have the plurality of shelves as wine shelves 300 for storing a plurality of wine bottles.

Further, the second storage 200 may be located below the first storage, and may have one or more drawers 210 and 220 in a form of being extended in a forward direction of the refrigerator. In the second storage, the second storage space where the food is stored may be exposed by the extension of the drawer, and the second storage space may be divided by the plurality of drawers.

Further, a machine room (not shown) for controlling temperatures of the first storage space 100*a* and the second storage space 200*a* may be defined in a separate space that is separated from the first storage space 100*a* and the second storage space 200*a* inside the refrigerator 10.

In this connection, the machine room may include a refrigerant cycle composed of a compressor, a condenser, an expander, an evaporator, and a flow path for supplying cold air to the first storage space 100*a* and the second storage space 200*a*. Various embodiments may be available for such a location and configuration of the machine room, so that a detailed description thereof will be omitted.

The second storage 200 may be located below the first storage 100, and may be used as the refrigerating compartment or the freezing compartment independently of the first storage 100. Such second storage 200 may include one or more drawers 210 and 220, each of which opens the second storage space 200*a* of the second storage 200, and defines a space for loading the food therein, at the same time. The drawers 210 and 220 may include an upper drawer 210 forming an upper front face of the second storage 200 and a lower drawer 220 forming a lower front face of the second storage 200.

Hereinafter, the first storage 100 will be described in detail with reference to the accompanying drawings.

Figure 3:
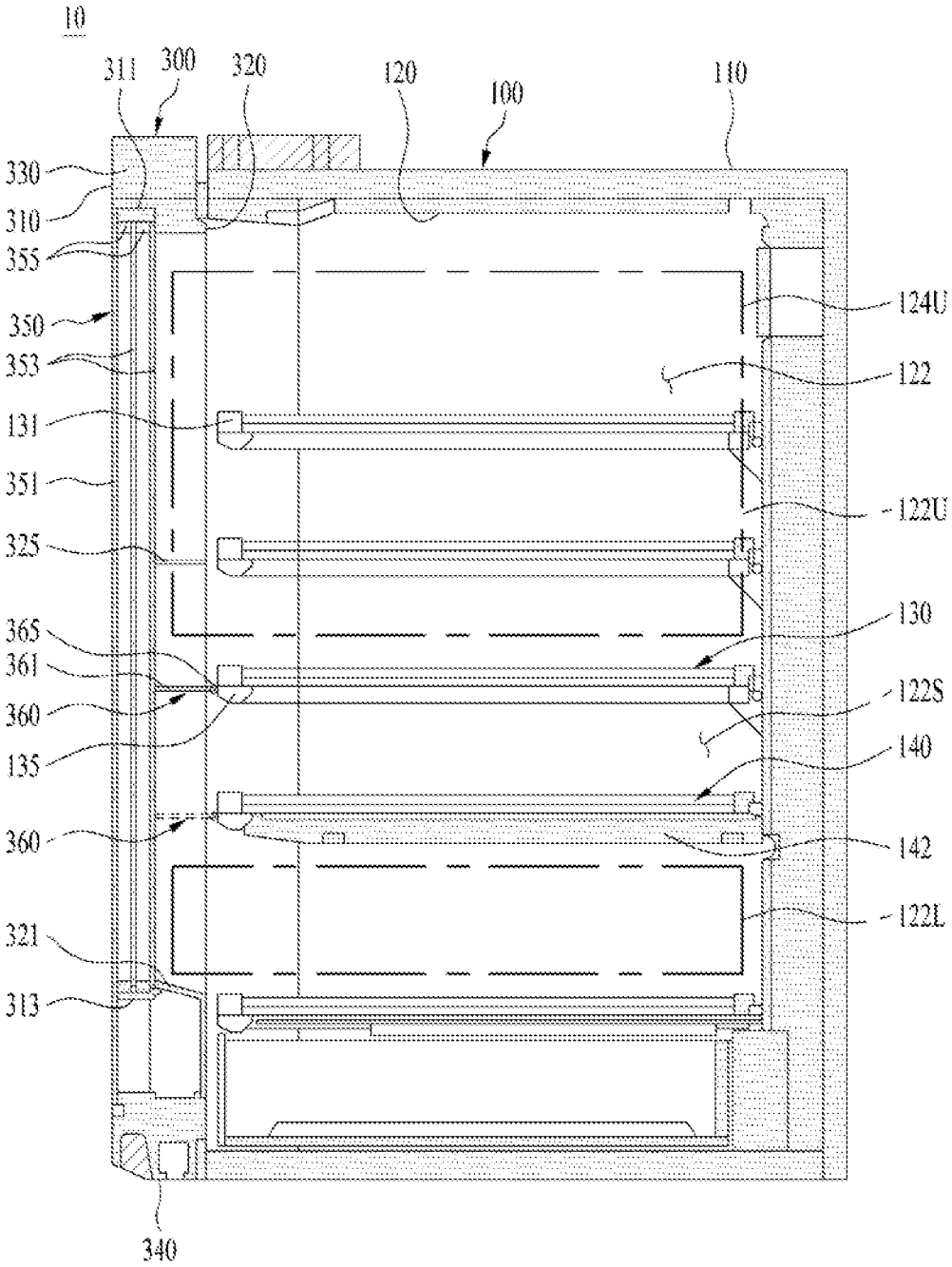
FIG. 3 is a simplified diagram illustrating an internal structure of a refrigerator according to the present disclosure.
Figure 4:
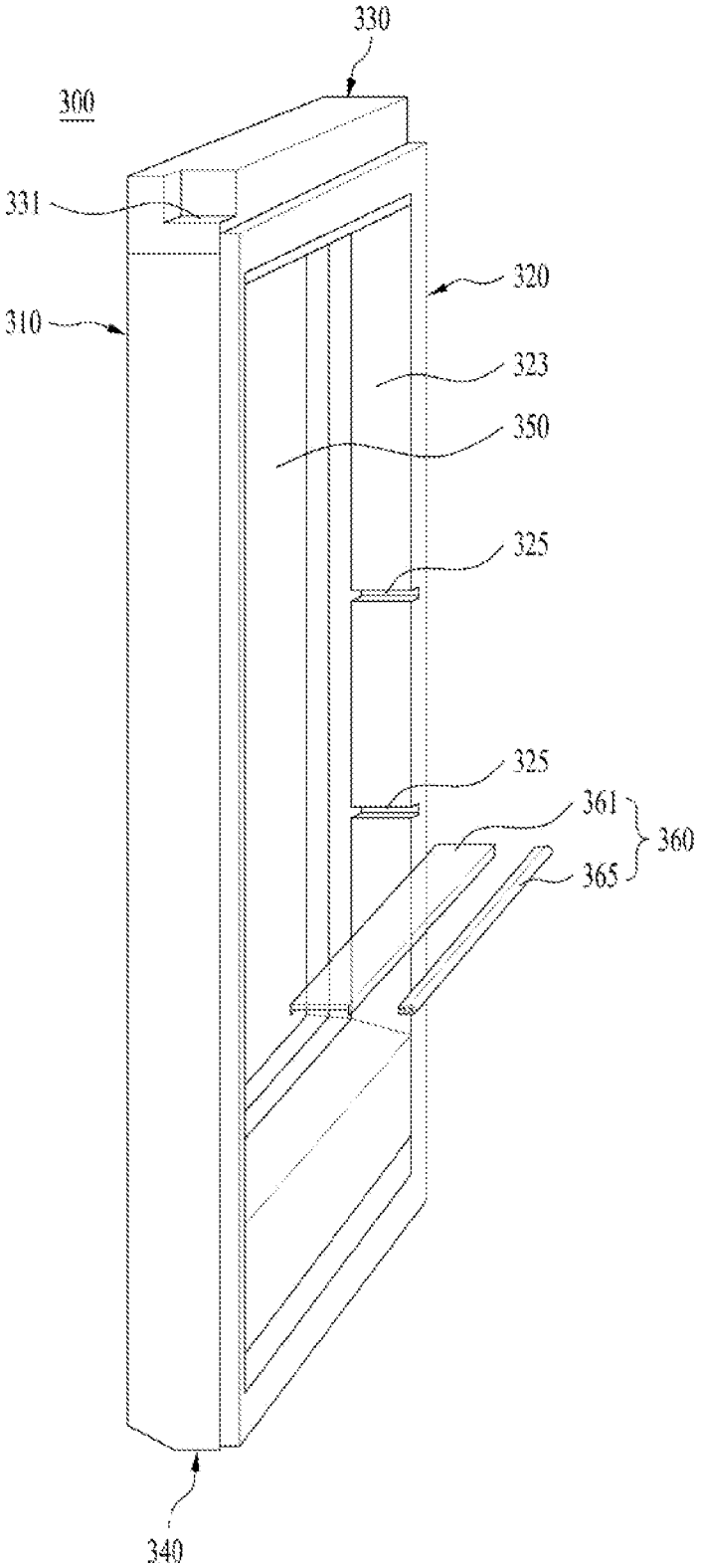
FIG. 4 is a rear perspective view illustrating a door and a flow path blocking portion of a refrigerator according to the present disclosure.

FIG. 3 is a simplified diagram illustrating the first storage 100 of the refrigerator according to the present disclosure. Further, FIG. 4 is a rear perspective view illustrating a door and a flow path blocking portion of the refrigerator according to the present disclosure.

As shown in FIG. 3, the refrigerator 10 according to the present disclosure is formed in a substantially rectangular parallelepiped shape with an open front face, and has the first storage 100 having the storage space defined therein, and a door 300 for selectively shielding the opened front face of the first storage 100.

First, the first storage 100 includes an outer casing 110 forming an outer shape, an inner casing 120 disposed inside the outer casing 110 in a shape corresponding to the outer casing 110 to define the first storage space 100*a* of the first storage 100, and a heat insulating material (not shown) disposed between the outer casing 110 and the inner casing 120 to prevent heat exchange between a specified space and the outside.

In this connection, the outer casing 110 forms a plurality of faces except for a front face of the first storage 100, that is, top/bottom and side/rear face of the first storage 100. Further, the outer casing 110 may be made of an iron plate material having gloss and a predetermined color such that the outer shape of the refrigerator 10 is easy on the eye.

Further, the inner casing 120 is injection-molded in a shape corresponding to the shape of the outer casing 110, and coupled to the outer casing 110 in a state of being spaced apart from the outer casing 110 by a predetermined distance. The heat insulating material (not shown) foams to form a heat insulating layer and is filled in a space between the inner casing 120 and the outer casing 110.

In one example, the first storage space 100*a*, which defines a space into which the cold air is supplied, and thus, the wine is stored therein, may be defined inside the inner casing 120. A plurality of wine shelves 130 on which the wine is placed are arranged on an inner rear face of the first storage space 100*a* such that a predetermined spacing is formed between two adjacent wine shelves in a vertical direction. In this connection, the spacing in the vertical direction between the two adjacent wine shelves is formed to be larger than a diameter of the wine to be placed on the wine shelves 130, and may be optionally adjusted as needed.

In one example, the inner first storage space 100*a* defined by the inner casing 120 may be divided into a plurality of storage regions 122U and 122L having different temperatures depending on a type of the wine stored therein.

In the present disclosure, the storage regions 122U and 122L may include a first region 122U located above and a second region 122L located below. The numbers of the first region 122U and the second region 122L may be increased or decreased to appropriate numbers depending on a capacity and a purpose of use of the first storage space 100*a*.

For example, red wine and the like, which are kept at a relatively high temperature, may be stored in the first region 122U, and white wine and the like, which are kept at a relatively low temperature, may be stored in the second region 122L.

As such, dividing of the first storage space 100*a* based on the temperature is because changing the storage temperature depending on the type of the wine is good for ripening of the wine, and a consumer's preference may be increased. Further, because an energy consumption efficiency may also be increased by efficiently maintaining the temperature depending on the storage location of the wine.

In one example, the first region 122U and the second region 122L described above may be formed by a partition plate 140 or the wine shelves 130 and a flow path blocking portion 360 formed on a door 300 to be described below.

That is, the first storage space 100*a* includes the partition plate 140 for spatially partitioning the first storage space 100*a*. The partition plate 140 partitions the first storage space 100*a* in a state of being fixed at a predetermined vertical level of the first storage space 100*a*. An upper portion of the first storage space 100*a* may be partitioned as the first region 122U, and a lower portion thereof may be partitioned as the second region 122L by the partition plate.

In this connection, the partition plate 140 is formed to be spaced apart at a predetermined spacing (preferably, a vertical level such that the wine may be stored) from a bottom of the first storage space 100*a*. A lower face of the first region 122U may be formed in a corrugated shape to place the wine thereon. A lower face of the second region 122L may also be formed in a corrugated form to place the wine thereon. Alternatively, a separate wine shelf may be installed near and above an upper face of the partition plate 140.

In one example, the wine shelves 130 arranged in the first storage space 100*a* are detachably arranged on a rear face of the inner casing 120 as shown in FIG. 4.

Such wine shelf 130 includes a frame 131 formed as a rectangular frame having a size corresponding to a depth and a width of the first storage space 100*a*, a plurality of support bars 133 formed inward of the frame 131 and coupled to the frame 131 in a front and rear direction, wherein a spacing smaller than the diameter of the wine bottle is formed between two adjacent support bars 133, and a shelf bracket 135 detachably mounted and fixed on the rear face of the inner casing 120, and supporting both sides of the frame 131, at the same time.

In addition, an extension rail (not shown) for supporting the frame 131 to be movable relative to the shelf bracket 135 may be further included between the frame 131 and the shelf bracket 135.

A front decor 139 extending in a width direction from a front face of the wine shelf 130, wherein the front decor 139 forms a front outer shape of the frame 131, and at the same time, is in contact with a front end of a blocking plate 361 to be described below, may be further formed on a front face of the frame 131.

Further, as shown in FIGS. 3 to 4, the door 300 is pivotably hinge-coupled to the open front face of the first storage 100, so that the door 300 selectively shields one face of the first storage 100 (i.e., opening of the first storage space 100*a*), and at the same time, is in contact with a specific wine shelf 130 to restrict flow of air toward a space between the door 300 and the specific wine shelf 130, thereby selectively partitioning the storage regions 122U and 122L of the first storage space 100*a*.

In one example, the door 300 includes door frames 310, 320, 330, and 340 to form an outer shape of the door 300 and a panel assembly 350 mounted inside the door frames 310, 320, 330, and 340.

In this connection, the door frames 310, 320, 330, and 340 may include an outer plate 310 forming the outer shape of the door 300, a door liner 320 spaced apart from the outer plate 310 and forming an inner face of the door 300, and an upper cap decor 330 and a lower cap decor 340 respectively forming an upper face and a lower face of the door 300.

In this connection, the outer plate 310 forms portions of a front face shape and a peripheral face of the door 300, which may be made of a stainless material. In addition, a panel mounting hole 311 in which the panel assembly 350 is formed is defined in a central portion of the outer plate 310.

In one example, a plate bent portion 313, which is bent vertically inwardly to mount a panel assembly 350 to be described below thereon, is formed along a circumference of the panel mounting hole 311

Further, the panel assembly 350 is formed to be able to shield the panel mounting hole 311. Further, in a state in which the panel assembly 350 is mounted, a front face of the panel assembly 350 may be flush with a front face of the outer plate 310. A configuration of the panel assembly 350 will be described in more detail below.

In one example, the upper cap decor 330 forms an upper face of the door 300, which is coupled to the outer plate 310 and an upper end of the door liner 320. Further, an upper hinge mounting portion 331 is defined at one end of the upper cap decor 330, and an upper hinge (not shown) is fastened to the upper hinge mounting portion 331 to be pivotable relative to the upper portion of the first storage 100.

Further, the lower cap decor 340 forms a lower face of the door 300, which is coupled to the outer plate 310 and a lower end of the door liner 320. Further, a lower hinge mounting portion 341 is defined in the lower cap decor 340, and a lower hinge is fastened to the lower hinge mounting portion 341 to be pivotable relative to the lower portion of the first storage 100.

In one example, two foaming liquid inlets (not shown) may be defined in the lower cap decor 340. The foaming liquid inlet is opened for injecting foaming liquid for forming a heat insulating material along a perimeter of the panel assembly 350 in an internal space of the door 300 and between the outer side plate 310 and the door liner 320.

In this connection, in order to smoothly inject the foaming liquid into the door 300, the foaming liquid inlets are defined so as to be open at positions vertically downward of the space between an outer face of the panel assembly 350 and the inner face of the door 300.

Therefore, when injecting the foaming liquid, the foaming liquid may be effectively injected without flowing backward or being unfilled by surrounding interference. The foaming liquid inlet may be shielded by a separate inlet cap (not shown) mounted on the lower cap decor 340.

In one example, the door liner 320 forms a rear face of the door 300, and a liner opening 321 is defined in a region where the panel assembly 350 is disposed. In this connection, the liner opening 321 is defined by liner inner side faces 323 extending toward the panel assembly 350, and the flow path blocking portion 360 to be described below is fastened to the liner inner side faces 323.

In this connection, a pair of liner grooves 325, each of which is for fastening the flow path blocking portion 360 thereto, are defined in both of the liner inner side faces 323 to face each other. A plurality of liner grooves 325 may be defined at positions corresponding to the plurality of wine shelves 130 formed in the storage space of the first storage.

The panel assembly 350 may include a front panel 351, at least one heat insulating panel 353 disposed rearward of the front panel 351, and spacer bars 355 respectively supporting between the front panel 351 and the heat insulating panel 353, and between the plurality of heat insulating panels 353.

Such panel assembly 350 is fixedly mounted in the panel mounting hole 311 of the outer plate 310. An outer peripheral face of the panel assembly 350 formed by the front panel 351, the heat insulating panel 353, and the spacer bar 355 may be adhered and fixed to an inner peripheral face of the panel mounting hole 311.

In addition, the front panel 351 of the panel assembly 350 may be formed in a form that extends than the heat insulating panel 353, and a rear face of the front panel may be adhered and fixed to a front face of the outer plate 310.

In one example, the front panel 351 may be made of a glass material that may selectively allow interior to be seen through based on transmittance and reflectance of light. Therefore, when lighting means (not shown) disposed in the first storage space 100*a* is turned on, as light at a first storage space 100*a* side passes through the front panel 351, the front panel 351 is seen as transparent.

Thus, the storage space rearward of the door 300 may be seen from the outside in a closed state of the door 300. In addition, when the lighting means disposed in the first storage space 100*a* is turned off, the light does not penetrate the front panel 351 and is reflected, and the front panel 351 becomes like a mirror face, so that the first storage space 100*a* cannot be seen from the outside.

In one example, the heat insulating panel 353 is formed to be smaller than the front panel 351 and located in an inner region of the front panel 351. Further, the heat insulating panel 353 is preferably a chemically strengthened glass, which is a glass chemically strengthened by being immersed in electrolyte solution at a temperature equal to or above a glass transition temperature.

Further, the closed space between the front panel 351 and the heat insulating panel 353 and the closed space between the plurality of heat insulating panels 353, respectively defined by the spacer bars 355 may be defined in a vacuum state and heat-insulated.

Alternatively, if necessary, inert gas for heat insulation may be filled in the closed space between the front panel 351 and the heat insulating panel 353 and the closed space between the plurality of heat insulating panels 353 to ensure a heat insulation performance.

In addition, a single heat insulating panel 353 may be mounted to be spaced apart from the front panel 351, and at least three heat insulating panels 353 may be spaced apart from each other if necessary.

Hereinafter, the flow path blocking portion will be described in detail with reference to FIGS. 5 to 6.

Figure 5:
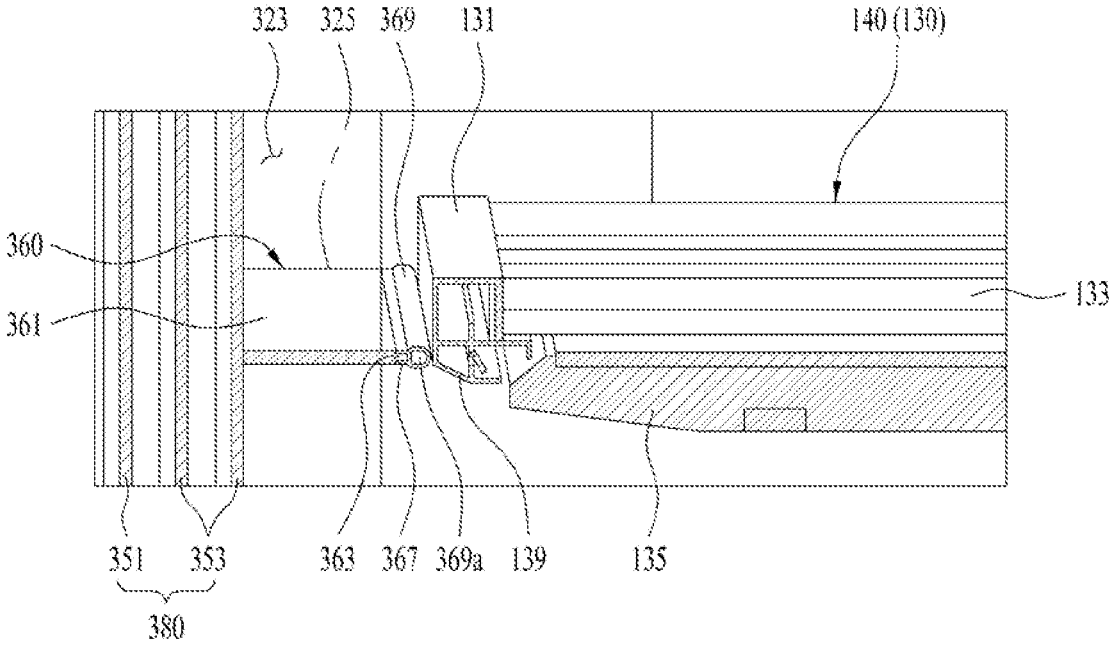
FIG. 5 is a partial cross-sectional perspective view illustrating a door and a flow path blocking portion of a refrigerator according to the present disclosure.
Figure 6:
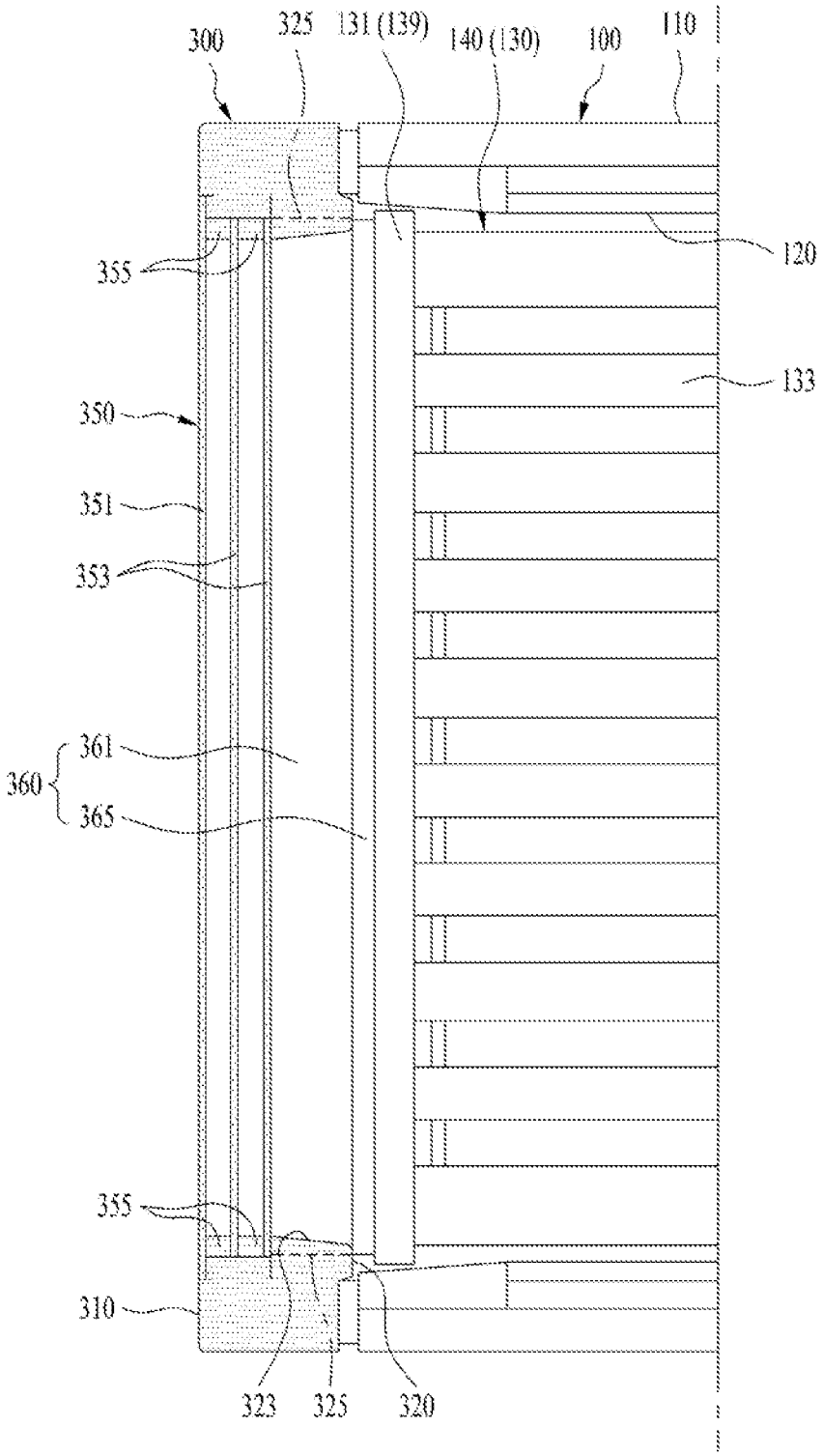
FIG. 6 is a plan view illustrating a door and a flow path blocking portion of a refrigerator according to the present disclosure.

FIG. 5 is a partial cross-sectional perspective view illustrating a door and a flow path blocking portion of a refrigerator according to the present disclosure. Further, FIG. 6 is a plan view illustrating a door and a flow path blocking portion of a refrigerator according to the present disclosure.

As shown, the flow path blocking portion 360 of the present disclosure is to partially restrict the flow of the air between the first region 122U and the second region 122L respectively above and below the wine shelf 130 on the basis of the wine shelf 130 when the door 300 closes the first storage space 100*a* by being mounted on the rear face of the door 300 in contact with the wine shelf 130 disposed in the first storage space 100*a*.

Such flow path blocking portion 360 may include a blocking plate 361 in close contact with and mounted on the rear face of the door 300 and a gasket 365 fastened to an end of the blocking plate 361 and in contact with the front face of the wine shelf 130.

In this connection, the blocking plate 361 may be detachably installed on the liner inner side faces 323 formed on the door liner 320 of the door 300. The plurality of liner grooves 325 are respectively defined in a direction facing the positions respectively corresponding to the wine shelves 130 arranged in the first storage space 100*a*.

In this connection, the blocking plate 361 may be slidably inserted and fixed into a facing linear groove 325. That is, the blocking plate 361 may block a space defined by the heat insulating panel 353 of the panel assembly 350 and the liner inner side faces 323 of the door liner 320.

Such blocking plate 361 may be made of the same material as the front panel 351 or the heat insulating panel 353 of the panel assembly 350. That is, when the blocking plate 361 is made of the transparent material like the front panel 351 or the heat insulating panel 353, the interior of the storage space may be prevented from being visually blocked by the blocking plate 361, so that the user may easily view the interior of the first storage space 100*a*.

In this connection, a fastening portion 363 for mounting the gasket 365 thereto may be further formed at the end of the blocking plate 361. The fastening portion 363 may be inserted into an insertion groove 367 to be described below defined in the gasket 365 to fix the gasket 365.

In one example, the gasket 365 is to shield a gap defined between the blocking plate 361 and the wine shelf 130 by being fastened to the end of the blocking plate 361. Such gasket 365 is formed with a length corresponding to a longitudinal side of the blocking plate 361, the insertion groove 367 into which the fastening portion 363 of the blocking plate 361 is inserted is defined at one side of the gasket 365 facing the blocking plate 361, and a buffer 369 is formed on the other side of the gasket 365 facing the wine shelves 130.

In this connection, the buffer 369 has a predetermined elastic force to prevent occurrence of an impact caused by a collision between the blocking plate 361 and the wine shelves 130 when opening and closing of the door 300. Preferably, a hollow 369*a* in communication with the gasket 365 in a longitudinal direction is defined inside the buffer 369, so that a buffer force may be formed by the hollow 369*a*.

Hereinafter, an operation of the refrigerator 10 according to an embodiment of the present disclosure will be described in detail with reference to the accompanying drawings. Each element to be mentioned below should be understood with reference to the above description and the drawings.

Figure 7:
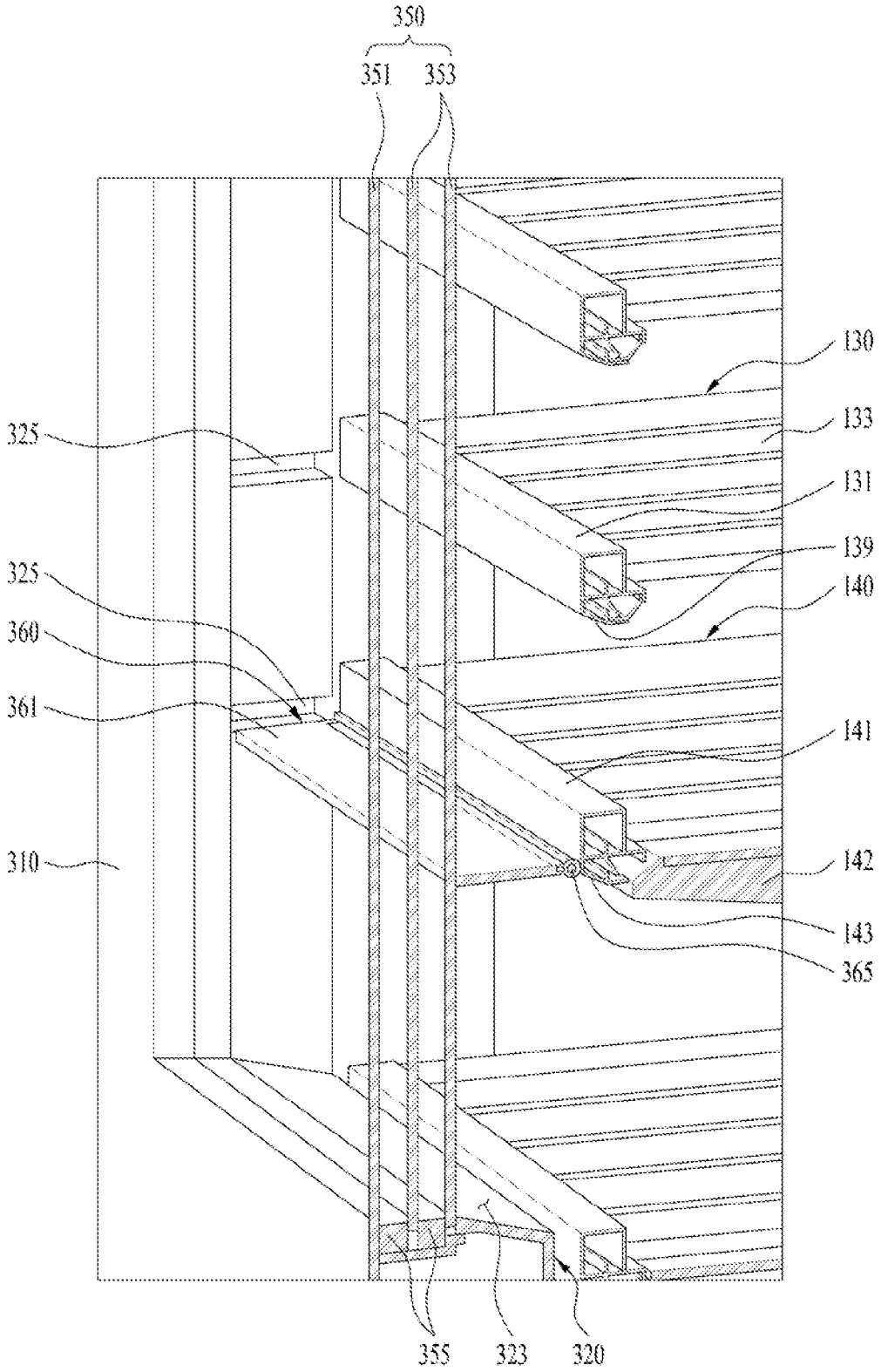
FIGS. 7 to 8 are partial cross-sectional views illustrating states of use of a refrigerator according to the present disclosure.
Figure 8:
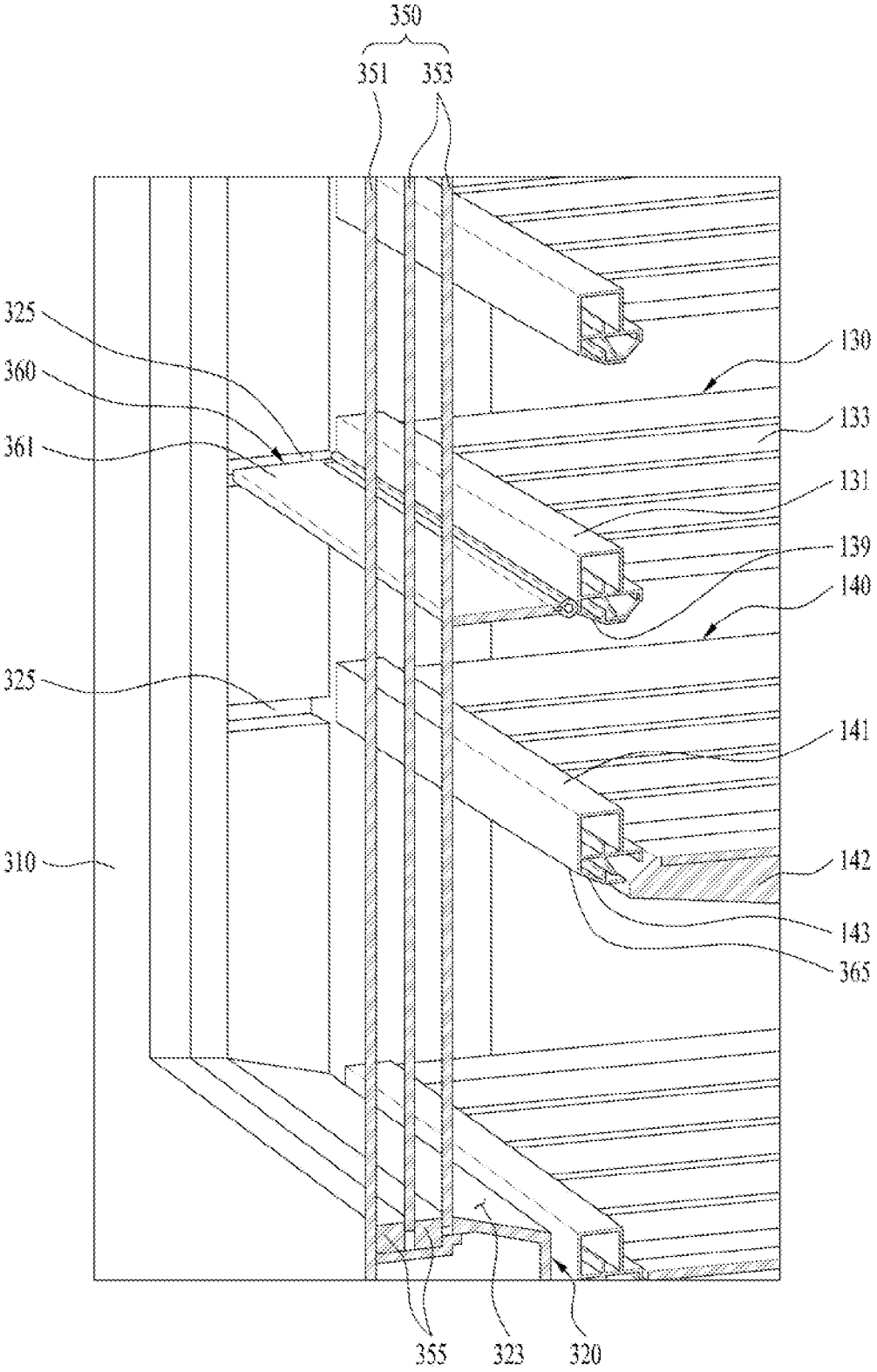

FIGS. 7 to 8 are partial cross-sectional views illustrating states of use of the refrigerator according to the present disclosure.

In this connection, in FIG. 7, the flow path blocking portion 360 of the present disclosure restricts the air flow between the first region 122U and the second region 122L in contact with the partition plate 140 partitioning the first region 122U and the second region 122L. In FIG. 8, the flow path blocking portion 360 of the present disclosure is in contact with one of the plurality of wine shelves other than the partition plate 140 to expand or contract the first region 122U or the second region 122L, thereby restricting the air flow between the first region 122U and the second region 122L.

Hereinafter, with reference to FIG. 7, it will be described that the flow path blocking portion of the present disclosure is in contact with the partition plate 140 to restrict the air flow between the first region 122U and the second region 122L.

As shown in FIG. 7, the flow path blocking portion 360 of the present disclosure is inserted into and installed in a liner groove 325 defined at a position corresponding to the partition plate 140 among the plurality of liner grooves 325 defined in the inner faces of the door liner of the door of the refrigerator 10.

In this connection, the partition plate 140 divides the first storage space into the first region 122U and the second region 122L, but there is a space in which the air may flow between the panel assembly 350 of the door 300 and the partition plate 140. When the air flows to the space between the panel assembly 350 of the door 300 and the partition plate 140, it may be rather difficult to artificially control the temperature distribution of the first region 122U and the second region 122L.

Accordingly, the flow path blocking portion shields the gap defined between the partition plate 140 and the panel assembly 350 of the door 300 to restrict the flow of the cold air into the space between the partition plate 140 and the panel assembly 350 of the door 300.

Hereinafter, with reference to FIG. 8, it will be described that the flow path blocking portion 360 of the present disclosure is in contact with the wine shelf 130 to restrict the air flow.

As shown in FIG. 8, the door 300 of the refrigerator 10 is equipped with the flow path blocking portion 360. Further, the user may selectively mount the flow path blocking portion 360 to a position corresponding to a specific wine shelf 130 among the plurality of wine shelves 130 on which the wine is stored based on a user's selection.

As described above, such flow path blocking portion 360 may be selectively mounted to correspond to the wine shelf 130 on which the wine is stored depending on a type of the wine stored on the plurality of wine shelves 130.

For example, the red wine may be stored on and above a specific wine shelf 130 and the white wine may be stored below the specific wine shelves 130. In this case, the blocking plate 361 of the flow path blocking portion 360 may be slidably inserted into a liner groove 325 defined in the door liner 320 of the door 300 corresponding to the specific wine shelf 130, so that the first storage space 100*a* above the specific wine shelf 130 may be formed as the first region 122U, and the first storage space 100*a* below the specific wine shelf 130 may be formed as the second region 122L based on the specific wine shelf 130.

Thus, as the cold air of the first storage space 100*a* flows between the support bars 133 of each wine shelf 130, the cold air is supplied to the first region 122U and the second region 122L. In this connection, a resistance of the flow of the cold air located above the specific wine shelf 130 on the basis of the specific wine shelf 130 in contact with the flow path blocking portion 360 occurs by the flow path blocking portion 360 in contact with the specific wine shelf 130, so that the cold air flow occurs less at the specific wine shelf 130 than other wine shelves 130.

Therefore, the cold air above the specific wine shelf 130 may be divided into the first region 122U and the second region 122L on the basis of the flow path blocking portion 360 and the specific wine shelf 130 in contact with the flow path blocking portion 360.

In addition, the blocking plate 361 forming the flow path blocking portion 360 may be made of the transparent material, or may be made of the same transparent material as the front panel 351 (or the heat insulating panel 353) forming the panel assembly 350 of the door 300. Therefore, the user may easily view the interior of the storage space by the panel assembly of the door and the flow path blocking portion of the transparent material.

As described above, although the preferred embodiments of the present disclosure have been described in detail, the present disclosure is not limited thereto, but may be variously modified and altered by those skilled in the art to which the present disclosure pertains without departing from the spirit and scope of the present disclosure claimed in the following claims. Thus, modifications of the aforementioned embodiments of the present disclosure will not be departed from the scope of the present disclosure.

The invention claimed is:

1. A refrigerator comprising:

a storage defining a storage space therein;

a door having an opening defined therein for opening and closing the storage space and mounted pivotable to the storage;

a plurality of shelves disposed in the storage space; and a flow path blocking portion mounted on the door, wherein the flow path blocking portion shields a gap between the door and a shelf among the plurality of shelves when the door closes the storage space, wherein the door includes:

a door frame having the opening defined therein, and mounted pivotable to the storage; and a panel assembly inserted into the opening, and disposed to allow the storage space to be seen through the panel assembly, wherein each of opposing inner side faces of the door frame defining the opening is inclined inwardly of the door such that the panel assembly is inserted and installed into the door frame, and wherein the flow path blocking portion is mounted between the inner side faces of the door frame.

2. The refrigerator of claim 1, wherein the flow path blocking portion is detachably mounted on the door in a selective manner to correspond to a position of the shelf among positions of the plurality of shelves disposed in the storage space.

3. The refrigerator of claim 1, wherein the flow path blocking portion includes a gasket at a longitudinal end thereof to be in contact with the shelf when the door closes the storage space.

4. The refrigerator of claim 1, wherein the flow path blocking portion is mounted on the door frame, and shields the gap between the panel assembly and the shelf when the door closes the storage space.

5. The refrigerator of claim 1, wherein the door frame includes:

an outer plate forming a front face of the door; and a door liner disposed rearward of the outer plate to form a rear face of the door.

6. The refrigerator of claim 5, wherein the flow path blocking portion is mounted on the door liner to shield the gap between the panel assembly and the shelf.

7. The refrigerator of claim 1, wherein a plurality of pairs of grooves are respectively defined at the inner side faces of the door frame at positions corresponding to the positions of the plurality of shelves, wherein opposite ends of the flow path blocking portion are inserted and disposed in a single pair of grooves among the plurality of pairs of grooves.

8. The refrigerator of claim 1, wherein the flow path blocking portion includes a blocking plate formed in a plate shape of a transparent material.

9. The refrigerator of claim 8, wherein the flow path blocking portion includes a gasket disposed at an end of the blocking plate to contact with a front end of the shelf when the door closes the storage space.

10. The refrigerator of claim 9, wherein the gasket includes a buffer that is hollow in contact with the front end of the shelf with a predetermined elastic force when the door closes the storage space.

11. The refrigerator of claim 1, wherein the panel assembly includes:

a front panel for shielding the opening and forming a front face of the panel assembly;

a heat insulating panel disposed to be spaced apart from the front panel by a predetermined distance and forming a rear face of the panel assembly; and a spacer bar disposed between the front panel and the heat insulating panel to define a heat insulation space together with the front panel and the heat insulating panel.

12. The refrigerator of claim 11, wherein the flow path blocking portion blocks a flow path between an inner face of the heat insulating panel and a front end of the shelf when the door closes the storage space.

13. The refrigerator of claim 1, further comprising another storage having another storage space defined therein and disposed below the storage, wherein the another storage space is operated independently of the storage space of the storage.

14. The refrigerator of claim 13, wherein the another storage includes at least one drawer extendable from the another storage space.

15. The refrigerator of claim 13, wherein the door further includes:

a manipulator for controlling the storage and the another storage; and a display for displaying operating states of the storage and the another storage.

* * * * *